United States Patent [19]

Topelko

[11] Patent Number: 4,934,311

[45] Date of Patent: Jun. 19, 1990

[54] WALLPAPER WATER TROUGH

[75] Inventor: Roy Topelko, Brantford, Canada

[73] Assignee: Trek Tron Coolers Inc., Brantford, Canada

[21] Appl. No.: 338,937

[22] Filed: Apr. 12, 1989

[30] Foreign Application Priority Data

Dec. 16, 1988 [CA] Canada ..... 586087

[51] Int. Cl.[5] ..... B05C 3/12

[52] U.S. Cl. ..... 118/419; 118/428; 118/429

[58] Field of Search ..... 118/400, 428, 429, 419, 118/423, DIG. 17

[56] References Cited

U.S. PATENT DOCUMENTS

| | | | |
|---|---|---|---|
| 262,352 | 12/1881 | Fullerton et al. | D8/14 |
| 645,496 | 3/1900 | Springer et al. | 118/419 |
| 662,606 | 11/1900 | Stanley | 118/DIG. 17 |
| 931,492 | 8/1909 | Ross | 118/DIG. 17 |
| 2,450,847 | 10/1948 | Wilson | 118/419 |
| 2,457,293 | 12/1948 | Winzer | 118/419 |
| 2,512,221 | 6/1950 | Bixby . | |
| 2,898,883 | 8/1959 | Reid et al. | 118/419 |
| 3,076,430 | 2/1963 | Bruce | 118/DIG. 17 |
| 3,113,886 | 12/1963 | Kolb | 118/419 |
| 3,288,609 | 11/1966 | Land et al. | 118/419 |
| 4,244,320 | 1/1981 | McCurdy | 118/419 |
| 4,377,983 | 3/1983 | Skarsten | 118/DIG. 17 |
| 4,676,188 | 6/1987 | McCurdy | 118/419 |
| 4,711,682 | 12/1987 | Barbe et al. | 156/71 |

*Primary Examiner*—Willard Hoag

[57] ABSTRACT

A two station wallpaper water trough includes a preformed flexible polystyrene container with an essentially vertical back wall, and an opposite front wall having a lower vertical segment transforming into an outwardly inclined upper segment through a transitional bend and a bottom and opposite complimentary moulded ends which defined, a first movable rod holding station at an elevation above the transition, a second movable rod station at an elevation below the transition, and a third fixed rod station at an elevation between transition and second station and between said second station and front wall. A fixed rod interfits between said fixed ends and a movable rod may be placed in the first station or second station said rod adapted to pass through the center of a roll of wallpaper and to carry the same.

4 Claims, 1 Drawing Sheet

WALLPAPER WATER TROUGH

This invention relates to an improved pre-pasted wallpaper trough assembly having a thin wall plastic tray and two roller bars.

In the prior art, for example McCurdy in U.S. Pat. No. 4,244,320 issued Jan. 13, 1981, discloses a Wallpaper Trough Assembly submerging in water a wetting rod fixedly in the trough and directing the pre-pasted roll or partial wallpaper to travel underneath the rod and thus through the water in the trough before exiting. The wallpaper roll rests, in part, against the wetting bar and also against the side wall of the trough and the wallpaper travels underneath the rod. As the thickness of the wallpaper roll diminishes, the wallpaper roll falls to the bottom of the trough 12 and wedges itself between the wetting rod 14 and bottom and wallpaper travel is impeded.

When cut lengths of pre-pasted wallpaper are put in this trough they also wedge themselves, inevitably, between the horizontal wetting rod 14 and bottom and complete wetting of the paper is never easily achieved.

Reid et al. in U.S. Pat. No. 2,898,883 issued Oct. 11, 1959, discloses an Apparatus for Wetting a Roll of Pre-pasted Wall Paper wherein the total roll is submerged and carried in part by a hanger. In a variation thereof the roll is positioned on a hanger above the water level to pass through the water and under a "u-shaped" rack having a wetting bar portion which ensures wetting. Travel of the paper through the water in both variants is impeded because of use of wire hangers and the paper binds.

Though both of these prior art references were intended to pre-wet pre-pasted wallpaper when on a single roll, they address the issue poorly and do not address the need of pre-wetting strips of pre-pasted wallpaper which have been cut to specific lengths prior to the wetting.

It is an objective of the invention to provide a water trough which, on the one hand, holds an elevated roll of wallpaper above the water line in the trough but allows the wallpaper, to be rolled off the roll through the water in the trough under a wetting bar and to be easily pulled and managed thereby and to be subsequently cut as required.

It is a further object of the invention to provide two bars, a fixed wetting bar or rod mounted in the water under which the wallpaper travels so as to ensure wetting and another paper holding, a movable bar that at a first paper roll carrying station carries a roll of wallpaper at an elevation above the water level so as to allow the wallpaper to travel, when pulled, into and through the water underneath the wetting rod and thence to exit from the water trough.

It is also an object to the invention to provide means to locate the movable paper holding rod at a second station that is at an elevation below the water level in the trough so as to allow pre-cut lengths of pre-pasted pre-cut wallpaper to be rolled from the second station while submerged within the water trough under the wetting rod so that the cut length may be removed in a wet condition from the trough.

The invention therefore contemplates a wallpaper trough comprising:

(a) a first fixed rod and a second movable rod, each with ends (b) a preformed flexible unitary container including a longitudinal backside, bottom, and front side having an essentially vertical lower segment stepping through an interface into an outwardly projecting inclined upper segment, and opposite ends, the ends adapted to carry the fixed rod at an elevation between the bottom and interface, and means to provide a first station for holding the movable rod at an elevation above the interface and a second station for holding the movable rod at an elevation below the interface.

BRIEF DESCRIPTION OF THE DRAWINGS

The invention will now be described by way of example and reference to the accompanying drawings in which:

Referring to FIG. 1, A wallpaper water trough is generally shown as 10 and includes a pre-formed flexible polystyrene container 11 with essentially one vertical side wall 12, an opposite side wall 13 having a lower vertical segment 14 and an upper inclined segment 15, and opposite complimentary end walls 16 all integrally moulded with an essentially flat and unitary bottom 17.

Figure 1:
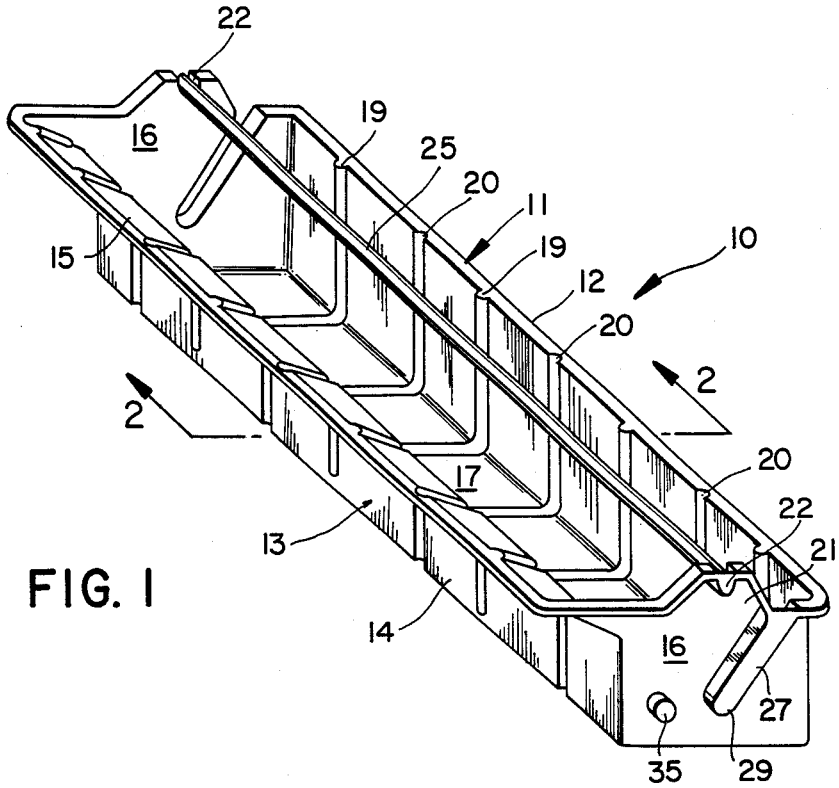
FIG. 1 is a perspective view of the invention.

Since the container 11 is thin walled in order to add rigidity integrally moulded therewith are lateral ribs generally indicated as 19 and 20. The ribs 19 are inwardly protruding while ribs 20 are outwardly protruding and appear from the interior of the container as lateral recesses.

Each end wall 16 has an upper upright portion of 21 centered along its upper margin with an arcuate recess 22 therein that establishes a first wallpaper holding station 22 for a movable wallpaper carrying rod or bar 25. This rod 25 carries a roll of wallpaper 30.

The end walls 16 are also moulded so as to define an angulated slot 27 whose bottom 29 at opposite ends is at an elevation which will be below the water line in the trough.

The water line generally is located at or slightly below the interface between the vertical segment 14 and the angulated segment 15 of the front wall 13 as seen in FIG. 2.

Figure 2A:
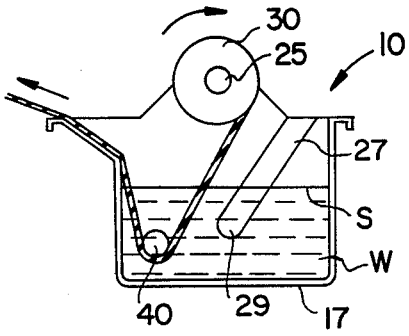
FIG. 2A is a section along line II—II of FIG. 1 with the movable rod is located in its first station.
Figure 2B:
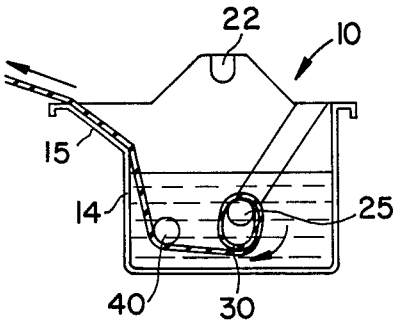
FIG. 2B is a section along II—II of FIG. 1 with the movable rod located in its second station position.

A fixed wetting rod or bar 40 is fixedly positioned at an elevation slightly below the bottom 29 of the slot 27 and this rod 40 is the wetting bar underneath which the wallpaper 30 travels as seen in FIGS. 2A and 2B. In that respect each end wall 16 has a cylindrical recess 35 that protrudes beyond the outside surface of the end 16 and accomodates opposite ends of the fixed wetting rod 40 so that the ends of the rod 40 nest in the recess formed by the cylindrical protrusions 35. The rod 40, if fabricated from polystyrene or even wood, and because of the length of the trough is approximately 24" (60 cm) or more, the natural flex in a rod allows it to be relatively easily inserted into the recesses 35 so as to hold the wetting rod 40 rigid in its fixed position while still allowing that rod to be removed for cleaning of the trough.

Referring to FIG. 2A the arrows indicate how the wallpaper is rolled off from the first station 22 through the water W in the trough, underneath the fixed rod 40, and exiting in the manner shown.

When pre-cut sheets of the roll of wallpaper are put on the movable paper holding rod 25 and that rod 25 is placed into the second station 29, as shown in the cross sectional FIG. 2B, the individual sheet of wallpaper is passed under the fixed rod 40 and pulled in accordance with the arrow shown, no paper binding occurs.

I claim:

1. A wallpaper water trough comprising;

(a) a first fixed rod and a second movable rod, each with ends (b) a preformed flexible unitary container including a longitudinal backside, bottom, and front side having an essentially vertical lower segment stepping through an interface into an outwardly projecting inclined upper segment, and opposite ends, the ends adapted to carry the fixed rod at an elevation between the bottom and interface, and means to provide a first station for holding the movable rod at an elevation above the interface and a second station for holding the movable rod at an elevation below the interface.

2. The trough as claimed in claim 1 wherein the second station is composed of a slot moulded into the end wall and is adapted to accomodate the end of the movable rod.

3. The trough as claimed in claim 2 wherein the side and bottom have spacely disposed integral ribs whereby to add rigidity to the trough.

4. The trough as claimed in claim 1 wherein the end walls define a cylindrical recess communicating the interior of the trough and protruding beyond the exterior surface of the end walls, whereby to accommodate the end of the fixed rod.

* * * * *